United States Patent [19]

Kuchenbecker

[11] Patent Number: 4,505,391

[45] Date of Patent: Mar. 19, 1985

[54] COOK-IN CARTON WITH IMPROVED INTEGRAL SUPPORT STRUCTURE

[75] Inventor: Morris W. Kuchenbecker, Neenah, Wis.

[73] Assignee: James River-Norwalk, Inc., Norwalk, Conn.

[21] Appl. No.: 523,864

[22] Filed: Aug. 16, 1983

Related U.S. Application Data

[63] Continuation of Ser. No. 274,803, Jun. 18, 1983, abandoned.

[51] Int. Cl.[3] ..... B65D 85/00; H05B 6/64

[52] U.S. Cl. ..... 206/622; 206/511; 206/605; 219/10.55 E; 220/70; 229/6 A; 229/30; 426/113; 426/122

[58] Field of Search ..... 206/605–615, 206/622, 629, 624, 625, 628, 599, 600, 45.12, 45.2, 45.21, 45.24, 45.25, 45.26, 511, 634; 229/16 A, 87 F, 16 D, 6 A, 30, 33, DIG. 11, 34 B; 225/48; 426/110, 113, 114, 123, 122; 220/69, 70; 248/150, 152, 174; 219/10.55 E, 10.55 M

[56] References Cited

U.S. PATENT DOCUMENTS

| | | | |
|---|---|---|---|
| 1,172,667 | 2/1916 | Bunnell | 248/174 |
| 1,559,071 | 10/1925 | Cavanagh | 206/45.26 |
| 2,025,280 | 12/1935 | Gregg | 206/45.24 |
| 2,232,632 | 2/1941 | Reynolds | 229/6 A |
| 2,744,675 | 5/1956 | Crane | 229/30 |
| 3,001,684 | 9/1961 | Wenzel | 229/16 D |
| 4,096,948 | 6/1978 | Kuchenbecker | 206/622 |
| 4,156,984 | 5/1979 | Wischusen | 229/30 |
| 4,279,374 | 7/1981 | Webinger | 426/113 |

*Primary Examiner*—Allan N. Shoap
*Assistant Examiner*—Bryon Gehman
*Attorney, Agent, or Firm*—Finnegan, Henderson, Farabow, Garrett & Dunner

[57] ABSTRACT

A cook-in carton includes a two-panel wall. The inner one of the two panels is provided with vent openings, and the outer one of the panels extends over the openings and is adhered to the inner panel by tabs on opposed edges thereof. The outer panel includes between the tabs a weakened section and opposed flaps. Parallel score lines are provided in each of the flaps, and lugs are formed on the free edges of the flaps upon removal of the weakened section. The flaps are then foldable, in accordion fashion, followed by insertability of the lugs into apertures aligned therewith, where they are restrained in formation of carton support legs.

6 Claims, 5 Drawing Figures

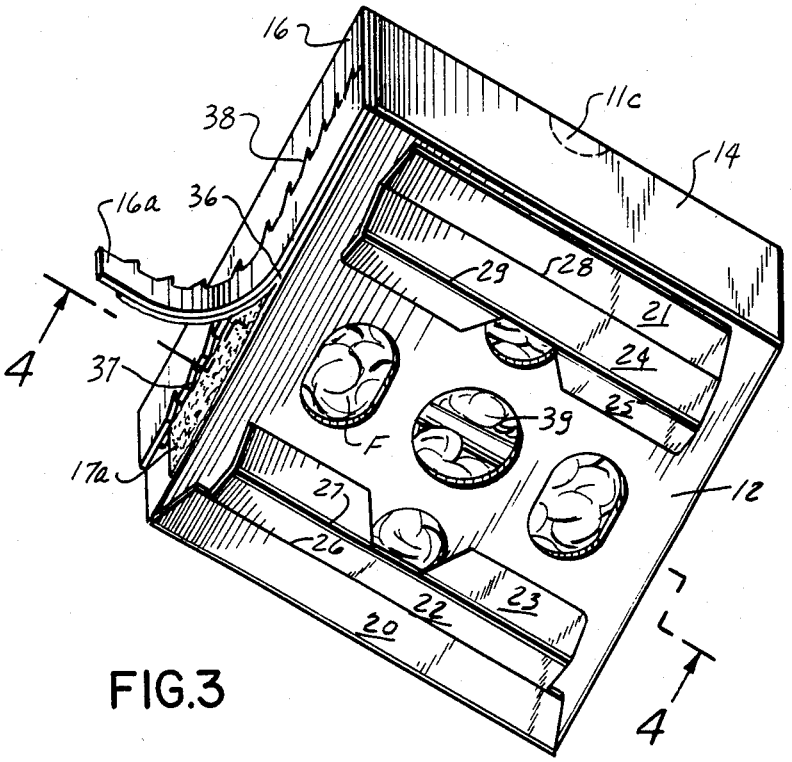
FIG.3
FIG.4
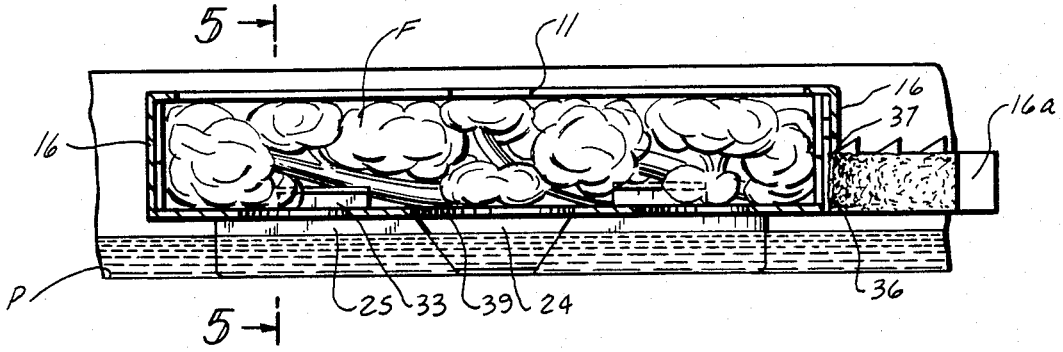
FIG.5
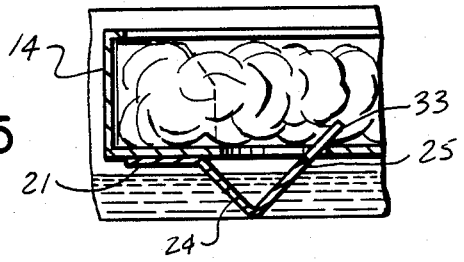

COOK-IN CARTON WITH IMPROVED INTEGRAL SUPPORT STRUCTURE

This is a continuation of application Ser. No. 274,803, now abandoned, filed June 18, 1983.

BACKGROUND OF INVENTION

This invention relates to cook-in cartons, and more particularly to an improved integral support structure for such a carton.

It is a known advantage to provide openings in cook-in cartons to facilitate venting and heating of the contents, especially in microwave ovens, as well as in conventional ovens. It is, of course, to be recognized that it is not desirable to subject all foods to the type of heating encountered in ovens. It is desirable, for example, to prepare frozen vegetables by subjecting them to steam. It is not always convenient to steam the vegetables in presently available, vented cook-in cartons. In preparing foods in this manner it is a preferred practice to rest the vented carton, by means of suitable support structure such as legs thereon, on the bottom of a closed pan in which boiling water is maintained at a level partially immersing the legs and spaced from the bottom wall of the carton. The legs are, however, usually comprised of but a single layer of paperboard which when subjected to the boiling water tend to collapse, undesirably immersing at least part of the carton and its contents. A carton of the hereinabove generally described type, and adapted primarily for use in microwave ovens, is disclosed in my U.S. Pat. No. 4,096,948, issued June 27, 1978, and assigned to the assignee of the present invention.

It is a general objective of the present invention to provide a cook-in carton with improved integral support leg structure characterized by its rigidity over a wide range of cooking conditions.

It is a further objective of the invention to provide an improved cook-in carton that facilitates steaming of its contents without damage to the carton.

SUMMARY OF THE INVENTION

In achievement of the foregoing as well as other objectives, the invention contemplates improvements in a cook-in carton of that type in which a two-panel wall thereof has its inner panel provided with vent apertures or openings over which there extends an outer panel having a weakened section covering some of the openings, and opposed flaps covering the remaining openings and having tabs adherent to the inner panel to mount the outer panel over the openings. Improvement resides in the provision of parallel score lines in each flap of the outer panel and a pair of lugs formed thereon upon removal of said weakened section, said pair of lugs being insertable into and retained within the ones of said openings aligned therewith, upon pivotation of said flaps about said score lines away from and toward said inner panel, thereby providing rigid support legs for said carton.

The manner in which the foregoing as well as other objectives and advantages of the invention may best be achieved will be more fully understood from a consideration of the following description, taken in light of the accompanying drawings.

BRIEF DESCRIPTION OF THE DRAWINGS

FIG. 3 is a perspective view, showing the removable section fully disengaged, with elements of the outer panel pivoted and restrained to form rigid support legs;

FIG. 4 is a section taken along line 4—4 in FIG. 3, and illustrating the carton seated upon a support surface; and FIG. 5 is a section taken along line 5—5 in FIG. 4.

DESCRIPTION OF THE PREFERRED EMBODIMENT

Figure 1:
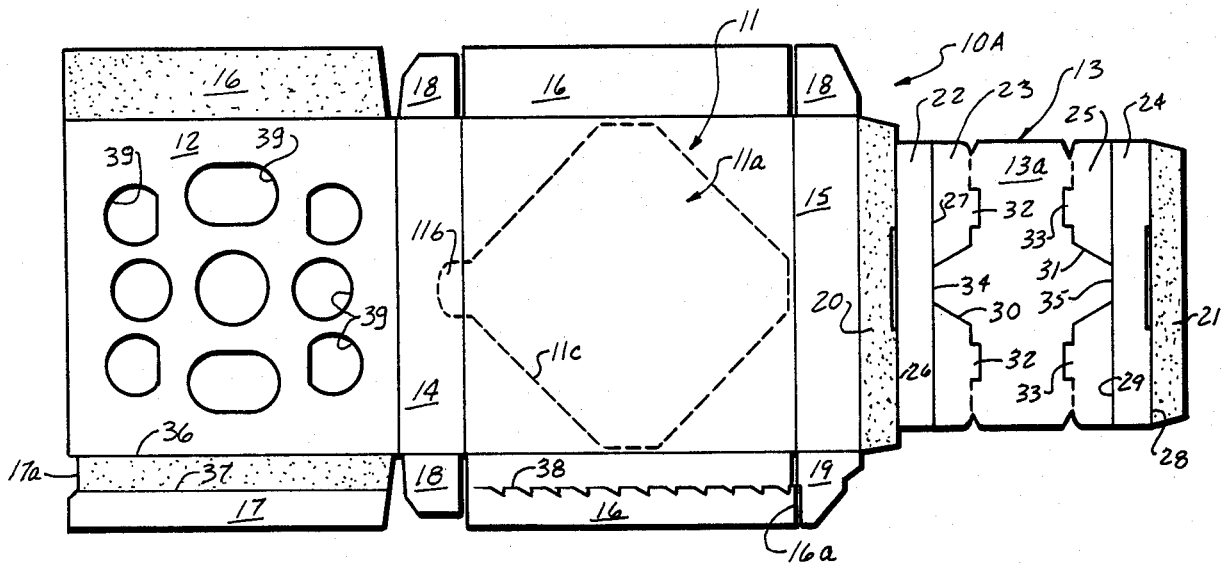
FIG. 1 is a plan view of the blank from which the carton of the present invention is constructed.

With more detailed reference to the drawings, and first to FIG. 1, a blank 10A for a carton 10, to be described in detail in the remaining Figures, includes a top panel 11 hingedly joined to panels 12 and 13 through relatively narrow side panels 14 and 15. The blank further includes hingedly connected end closure flaps 16, 17 and closure tabs 18, 19. Means for opening the carton, as will be more fully described hereinbelow, includes a tear-out panel section **11*a* defined by perforation forming a line of weakness 11*c* that extends onto side panel 14 in provision of a tear-tab 11*b*. Blank 10A** preferably is made of paperboard coated on both sides with low density polyethylene (LDPE).

Panel 13 includes a pair of glue tabs 20 and 21, the former adjacent side panel 15 and slightly longer than glue tab 21. Glue tabs 20 and 21 are connected to a central panel portion **13*a* through folding flaps 22, 23 and 24, 25, respectively. More particularly, flap 22 is hinged to glue tab 20 along a score line 26, and to flap 23 through a score line 27. Similarly flap 24 is hinged to glue tab 21 along a score line 28, and to flap 25 through a score line 29. Further to the construction of central panel portion 13*a*, lines of weakness 30 and 31 join it to panels 23, and 25, respectively. The lines of weakness are so configured as to be mirror images of one another, including closely spaced offset parallel sections that form small lugs 32, 33 in respective flaps 23 and 25, and widely spaced elongate cut sections 34, 35 coincident with score lines 27 and 29, respectively. In effect, the offset disposition of cut sections 34, 35 create notched configurations of flaps 23 and 25. These same flaps may, of course, be of one piece, coextensive with flaps 22 and 24. In essence flaps 22, 23 are elements of a larger flap foldable in accordion fashion along a central fold line 27 and a base fold line 26. Analagous structure is found in flaps 24, 25 and fold lines 29, 28**.

Further to construction of the blank, the lower end tabs 17 and 16 as viewed in FIG. 1 are to cooperate with one another and with closure flaps 18 and 19 adjacent thereto, in the set-up mode of the carton, to serve as an alternative means for opening the carton, along the relatively narrow side thereof. In provision of this opening feature, end tab 17 is hingedly connected along a cut score 36 to panel 12, includes cut score 37 parallel to cut score 36 and spaced therefrom toward the free edge of the flap, both cut scores 36 and 37 being on the surface opposite to the one viewed in FIG. 1. A line of weakness 38 in flap 16 is aligned with cut score 37. For reasons also to be more fully appreciated from the set up mode of the carton to be described hereinbelow, the left end of flap 17 includes a shallow notch **17*a* that extends between cut scores 36 and 37**. Construction of this alternative opening feature is disclosed and claimed in my copending application Ser. No. 274,790 filed June 18, 1981, and assigned to the assignee of the present invention.

A pattern of apertures 39 essentially completes the blank. Conveniently, the pattern is a generally square array, wherein the corner apertures 39 preferably are generally D-shaped and aligned with lugs 32 and 33 for reasons to be more fully explained hereinbelow in connection with use of the carton. It will be understood, however, that these corner apertures may comprise elongate slots, and that the remaining apertures may be formed in other shapes and sizes, and may differ in quantity over what is shown.

Figure 2:
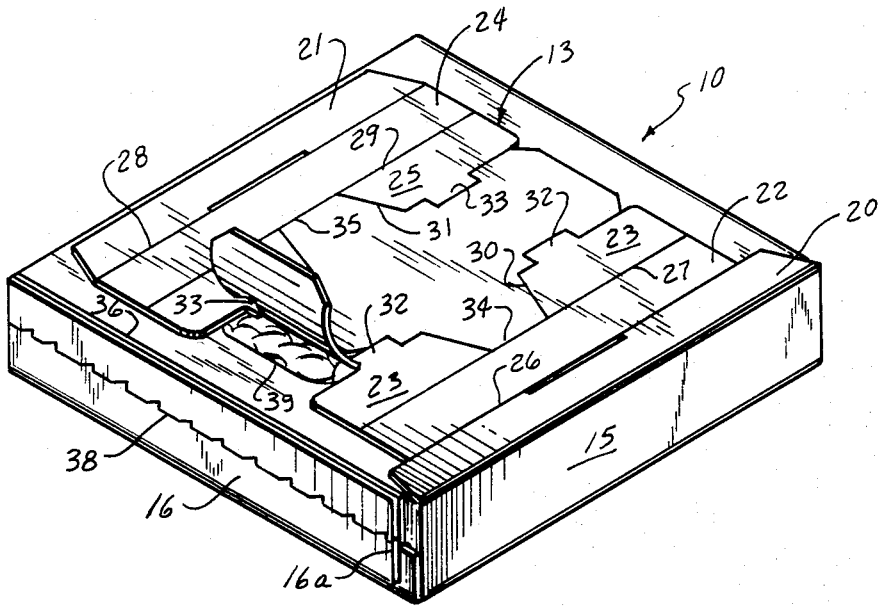
FIG. 2 is a perspective view of a carton embodying the invention, with the removable section of the outer panel partially disengaged.

Turning now to FIG. 2, carton 10 has been formed from cut and scored blank 10A. More particularly, and using panel 11 as a reference, the carton has been formed by folding side panels 14 and 15 vertically, at right angles to panel 11, followed by folding panel 12 on side panel 14 to a position confronting and parallel to panel 11. Panel 13 is then folded on side panel 15 to a position overlying panel 12 and glue tabs 20 and 21 are adhered to panel 12, using a suitable adhesive in the areas indicated by surface stippling in FIG. 1, in formation of a two panel wall. With contents in place, for example a loosely packed vegetable designated generally by the letter F in FIGS. 3 and 4, closure tabs 18 and 19 are folded inwardly, flaps 16, 17 on panel 12 are folded over the tabs, and flaps 16 on panel 11 are folded over and adhered to underlying flaps 16, 17 in the hatched regions thereof (FIG. 1).

Prior to heating contents F of the carton, and still with reference to FIG. 2, and also to FIGS. 3 to 5, central panel portion **13*a* of panel 13 is grasped at one end by the user and peeled away from the carton by tearing along lines of weakness 30 and 31. The corner openings 39, however, are still covered by flaps 23, 25, and other of the openings 39 are, in effect, exposed between flaps 23, 25. Flaps 22 and 23 are then folded in accordion fashion along score lines 26, 27 to lock the panels in place by inserting lugs 32 with angularity in corner apertures 39 aligned therewith. Similarly, panels 24 and 25 are folded along score lines 28, 29, and lugs 33 are inserted with angularity in corner apertures 39 aligned therewith to lock the folded panels in place. Folding and locking of the legs in place uncovers the corner openings 39. Locking of the legs is positive, due to angular extent of the lugs, in combination with the inherent flexibility and resilience of the paperboard from which the legs are formed. Also, prior to heating of the carton and its contents, and with reference to FIGS. 1 and 4, the tear out panel section 11*a* is removed by pushing in and grasping tab 11*b*, and tearing panel section 11*a* along line of weakness 11*c*** partially to open the carton for venting of its contents during steaming.

The folded and locked panels advantageously form rigid legs which support the carton on a suitable surface, for example the bottom of a covered pan P (FIG. 4) in which boiling water is maintained at a level just below the apertured panel 12 of the carton. Advantageously, the open bottom and top panels of the carton accommodate substantially full exposure of contents F to steam.

In the event that, due to the nature of the carton contents, it is desired only to subject the carton and its contents to warming or cooking in a microwave oven, and thereafter to remove the contents, tear-out section **11*a* is left in place, and the legs are set up in the manner hereinabove described to support the package for cooking. After cooking the tear strip created by provision of line of weakness 38 in flap 16 is removed by grasping portion 16*a* and pulling same away from the carton. To facilitate grasping and removal of the tear strip, the notch 17*a* underlies the strip a sufficient distance from its end to accommodate grasping and pulling it away from the carton. As the strip is pulled away, the underlying portion of flap 17 bound by cut scores 36 and 37, and adherent to the strip, undergoes ply separation, permitting flap 17** to pivot outwardly in provision of access to the contents.

While a preferred embodiment of the invention has been described and illustrated, it will be understood that modification may be resorted to within the scope of the appended claims.

I claim:

1. In a carton for use in heating a product contained therein, including a plurality of hingedly interconnected panels forming said carton, two of said panels being similarly dimensioned and configured and being secured in face-to-face contact to provide inner and outer panels of a two-panel wall in said carton, a central portion of said inner panel having first openings formed therein to permit substantial exposure of the contained product, the outer of said two panels having two lines of weakness extending completely thereacross for defining a centrally located removable weakened section, said removable section being dimensioned and configured to cover said first openings of said inner panel, a pair of rectilinear first score lines, each first score line extending along an opposite region of said outer panel, one rectilinear first score line on each side of said weakened removable section, each first score line located between one end of said outer panel and one of said lines of weakness, for defining two foldable flaps therebetween, the portions of said outer panel between said flaps and the end of said outer panel comprising tabs secured to said inner panel so that, upon removal of said removable section of said outer panel, said flaps may be folded about said first score lines away from said inner panel, thereby providing support legs on said carton, and disengagement of said removable section from the remainder of said outer panel uncovering said first openings and effecting substantial exposure of the product contained within the carton, the improvement comprising:

a second score line on each said flap, extending parallel to each said first score line and located between each said first score line and said line of weakness nearest said first score line; and at least one locking lug extending from the free edge portion of each of said flaps;

said inner panel having at least two second openings additional to said first openings, said second openings being formed in said inner panel underlying each said flap and being configured for receiving each said lug therein upon folding said flaps away from said inner panel on said first score lines and back towards said inner panel on said second score lines for positively locking each said flap portion into a triangular folded support position with the base of one side of the triangular support being the portion of said inner panel containing said second openings and with the other two sides of the triangular support forming a channel for directing steam into said second openings in said inner panel.

2. A carton according to claim 1, wherein each said flap has a notch extending from said free edge portion toward said centrally extending second score lines, said notch being formed by removal of said outer panel, and exposing at least one of said first openings in said inner panel.

3. A cook-in carton formed of a suitably cut and scored blank, having top and side walls, and a two-panel bottom wall, said bottom wall including an inner panel having an array of venting openings and an outer panel having a weakened section covering some of said openings, opposed flaps covering the remaining openings adjacent said flaps and adherent to the inner panel to mount the outer panel over the openings, and said flaps being foldable about provided first score lines away from said inner panel upon removal of said weakened section to uncover said openings, in provision of support legs for said carton, wherein the improvement comprises:

a second score line in each said flap parallel to said first score line;

a pair of lugs formed in each said flap upon removal of said weakened section; and said pair of lugs being insertable into and retained within one pair of said openings aligned therewith, upon folding of each said flap about said first score line and said second score line, away from and then toward said inner panel, thereby providing support legs for said carton.

4. A carton according to claim 3, wherein each said flap has a notch extending from said free edge portion toward said second score line, said notch being formed by a correspondingly shaped and disposed line of weakness upon removal of said outer panel, and exposing at least one of said recited openings in said inner panel.

5. A carton according to claim 3 or 4, wherein said top wall has a tear-out portion defined by lines of weakness so disposed as to form an opening in said top wall opposite said array of openings in said inner panel of said bottom wall.

6. A carton according to claim 1 or 3, wherein said carton is paperboard.

* * * * *